United States Patent [19]

Meagher

[11] 4,165,002

[45] Aug. 21, 1979

[54] PRODUCT AUTHENTICATION SYSTEM

[75] Inventor: Richard R. Meagher, Toms River, N.J.

[73] Assignee: The Rescon Corporation, Newark, N.J.

[21] Appl. No.: 807,222

[22] Filed: Jun. 16, 1977

[51] Int. Cl.[2] ..... B65D 75/28

[52] U.S. Cl. ..... 206/459; 206/312; 206/424; 116/234

[58] Field of Search ..... 116/119, 114 AJ, DIG. 41; 229/55; 206/459, 309, 312, 313, 424, 307, 807; 428/201, 207, 211; 40/359-360, 312, 306

[56] References Cited

U.S. PATENT DOCUMENTS

| | | | |
|---|---|---|---|
| 1,714,349 | 5/1929 | Dahlke | 229/68 R |
| 2,167,637 | 8/1939 | Claff | 40/312 |
| 2,266,905 | 12/1941 | Potdevin | 229/55 |
| 2,294,364 | 9/1942 | Currier | 229/55 |
| 2,986,325 | 5/1961 | Loderhose | 206/312 |
| 3,077,263 | 2/1963 | Froehlig | 206/313 |
| 3,301,467 | 1/1967 | Shore | 206/312 |
| 3,426,960 | 2/1969 | Shore | 206/312 |
| 3,473,653 | 10/1969 | Nunes | 206/313 |
| 3,556,391 | 1/1971 | Kosterka | 206/312 |
| 3,742,634 | 7/1973 | Haaften | 40/359 |
| 3,827,552 | 8/1974 | Janhonen | 229/55 |
| 3,850,366 | 11/1974 | Saito | 206/616 |
| 3,962,807 | 6/1976 | Pantone | 40/360 |

*Primary Examiner*—Herbert F. Ross

*Attorney, Agent, or Firm*—Lerner, David, Littenberg & Samuel

[57] ABSTRACT

A system is provided for authenticating products having a paperboard cover or package, such as a record sold in a paperboard record jacket, a tape sold in a paperboard tape box, or a book having a paperboard cover. The cover or package includes a plurality of walls wherein at least one of the walls includes a sheet of paperboard material, with the sheet being formed from a plurality of plies of paperboard material. In addition, at least one of the internal plies of the paperboard sheet is coded, such as by color or phosphorescent material, either continuous or in stripes, to act as an indicator. The coded ply is visible along the edge of the wall of the cover or package to provide a system for authenticating the product.

38 Claims, 6 Drawing Figures

PRODUCT AUTHENTICATION SYSTEM

FIELD OF THE INVENTION

The present invention relates generally to a product authentication system wherein at least one wall of the product cover or package has one or more internal plies coded to act as an indicator of the authenticity of the product.

BACKGROUND OF THE INVENTION

In recent years, the so-called "tape pirates" have flourished. Such pirates duplicated original recordings on tapes and/or records and sold them under their own labels at a much lower price than the authentic producer of the records and/or tapes. However, the copyright law was recently amended to make such duplication illegal.

This has led to another form of tape or record piracy, which may be referred to as total counterfeiting of the record and album jacket or tape and tape box to produce a counterfeit product which is substantially identical to the authentic product. This has also occurred in the paperback book industry where "book pirates" have produced counterfeit books which are substantially identical to the authentic books. In fact, the counterfeit product so closely resembles the authentic product that once such counterfeit products enter the channels of trade, such as the retail store, such counterfeit products cannot be readily distinguished from the authentic products. This counterfeiting problem has greatly plagued the authentic producers, as it is decreasing the profitability of expending large sums of money to produce and distribute original recordings and books. Accordingly, it would be highly desirable to provide a system whereby such counterfeit products may be readily distinguished from the authentic products and removed from the marketplace. In addition, it would also be highly desirable to provide such a detection system which will make it possible to track down the counterfeit producers so that their operations can be discontinued.

However, there is no simple detection system of the type suggested presently in existence. It is known to identify paper products through coloring, but such coloring would not be suitable for products, such as album jackets or book covers. More particularly, various paper mills have produced colored paperboard for the making of such products as game boards. The purpose of employing such color in the game board was for vendor identification so that it could be determined which vendor produced the paperboard used to manufacture the product. However, in such boards, the edges of the colored layers were not intended to be exposed after conversion, and it would have been necessary to damage or destroy the product, such as the game board, to make the color visible. Accordingly, such an identification system would not be suitable or practical for products, such as record jackets or book covers, wherein the product would have to be damaged or destroyed in order to be inspected. In addition, such an identification system could not be used to authenticate products, since different vendors used different colors for the same product. It is therefore highly desirable to provide a simple detection system which can quickly indicate whether a product is authentic or counterfeit by merely viewing the package or cover and without damaging same. In this manner, the counterfeit products can be removed from the channels of trade, but the authentic products, after being inspected, would still be suitable for sale. It would also be highly desirable to provide such a product authentication system which is inexpensive to implement, but which would be very difficult to duplicate, even if the authentication system were discovered.

Broadly, it is an object of the present invention to provide a product authentication system which solves one or more of the aforesaid problems. Specifically, it is within the contemplation of the present invention to provide a product authentication system for products having a paperboard cover or package which allows the product to be easily inspected for authenticity without damaging or destroying the package or cover.

It is a further object of the present invention to provide such a system whereby authentic products may be readily distinguished from counterfeit products by simply inspecting the paperboard packages or covers.

It is a still further object of the present invention to provide a product authentication system which is inexpensive to implement and produce, and which is difficult to duplicate even if the existence of the system is uncovered.

SUMMARY OF THE INVENTION

Briefly, in accordance with the principles of the present invention, an improved product authentication system is provided for products having a paperboard cover or package, such as a record sold in a paperboard record jacket or a book having a paperboard cover. The cover or package includes a plurality of wall wherein at least one wall includes a sheet of paperboard material, with the sheet being formed from a plurality of plies or layers of paperboard material. In the sheet, one or more of the internal plies of paperboard material are coded, such as by color or phosphorescent material, either continuous or in stripes, to act as an indicator. The coded plies are visible along the edge of the wall to indicate the authenticity of the product.

To produce a coded sheet of paperboard material, it is necessary to modify the conventional papermaking process by the addition of a suitable indicator, such as a dye or phosphorescent material, to the paperboard material. For example, as will be explained in detail herein, the indicator or dye may be added to the head box, which contains the slurry used to produce the paperboard material. Alternatively, the indicator or dye may be added to one of the stocks of the pulper at the beginning of the process or may be applied in the form of stripes or other configurations at the forming area.

It should also be noted that the desired coded plies of paperboard material may be made by using any multiply former, such as the cylinder machine, starting with wastepaper or a combination of wastepaper and virgin fiber pulp. Alternatively, the coded plies may be made on a Fourdrinier paper machine having more than one head box utilizing the same raw materials.

Advantageously, the coded paperboard material is inexpensive to produce. If color coding is employed, it is only necessary to add a suitable dye to the papermaking process. If the coding is to be done by a phosphorescent material, this can also be added during the papermaking process. Alternatively, indicator stripes or specially-treated fibers can be applied to the paperboard material during the processing of the wet slurry or at the forming area. In addition, in some types of packages, it may be desirable to provide a tear-away portion which exposes the coded layer, in a manner to be explained.

Not only is the product authentication system of the present invention inexpensive to produce, but it is also difficult to duplicate even after it is discovered by potential counterfeiters. That is, the coded paperboard material must be produced by paperboard manufacturers, and the paperboard manufacturers will supply the coded paperboard material only to converters who are authorized to produce the authentic paperboard packages or covers.

The product authentication system of the present invention also has the advantage of quickly and easily indicating the authenticity of a product by merely inspecting an exposed edge of the paperboard package or cover. There is no need to damage or destroy the package or cover in order to inspect it. Accordingly, even if authentic and counterfeit products are mixed together at some point in the channels of trade, such as the retail store, each of the products can be quickly examined and the counterfeit products removed. As the authentic products are not damaged by the inspection, they are still saleable after the inspection.

BRIEF DESCRIPTION OF THE DRAWINGS

Further objects, features, and advantages of the present invention will become apparent upon the consideration of the following detailed description of presently-preferred embodiments, when taken in conjunction with the accompanying drawings, wherein.

DETAILED DISCUSSION OF PREFERRED EMBODIMENTS OF THE INVENTION

In order to understand how the coded paperboard material employed in the paperboard packages and covers of the present invention is produced, a brief description of the conventional paperboard-making process will be given. It will then be explained how this conventional process is modified to produce the coded paperboard material.

Figure 1:
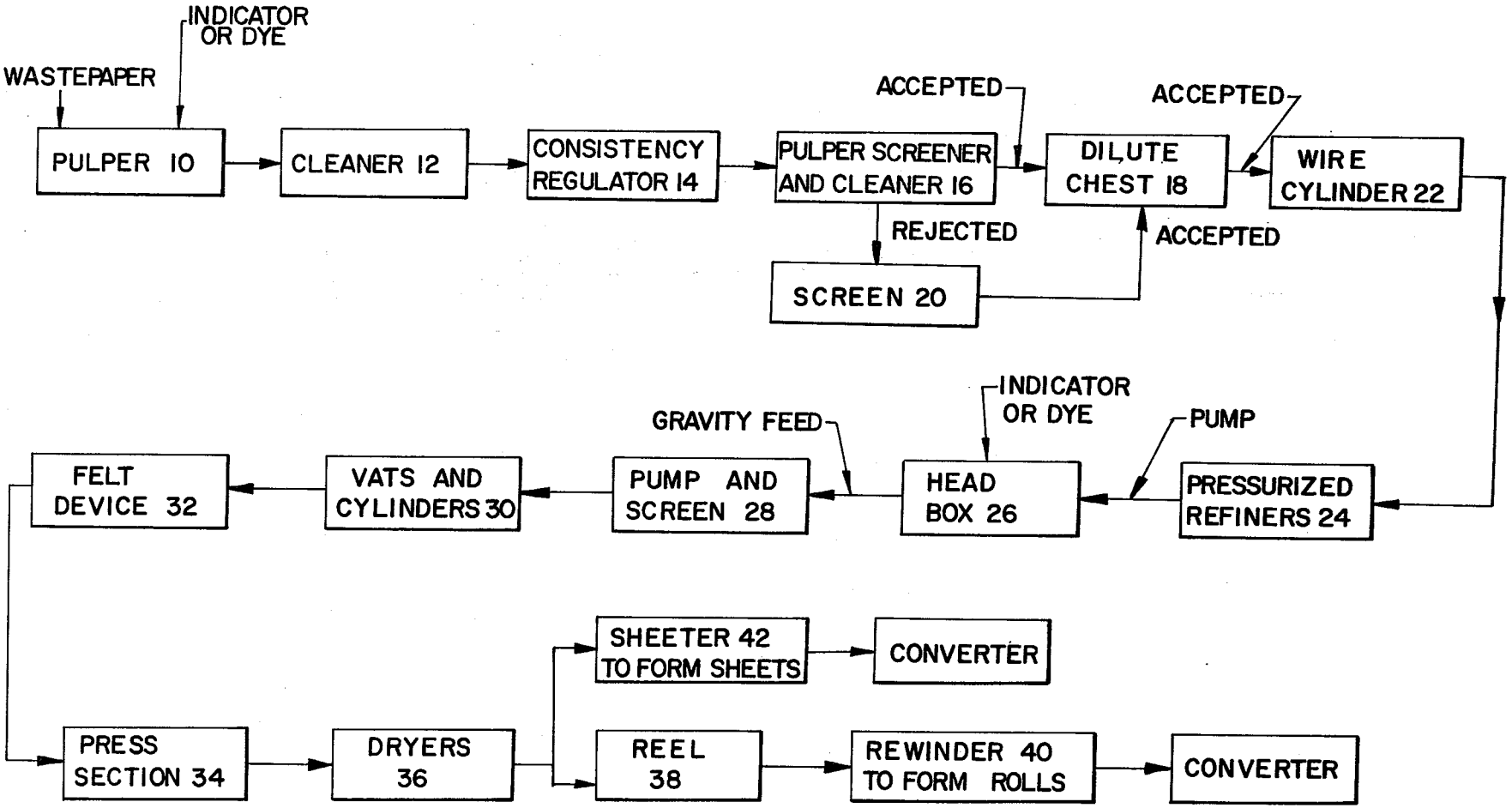
FIG. 1 is a diagrammatic representation of the paperboard-making process which is utilized to produce the coded paperboard material employed in the present invention.
Figure 2:
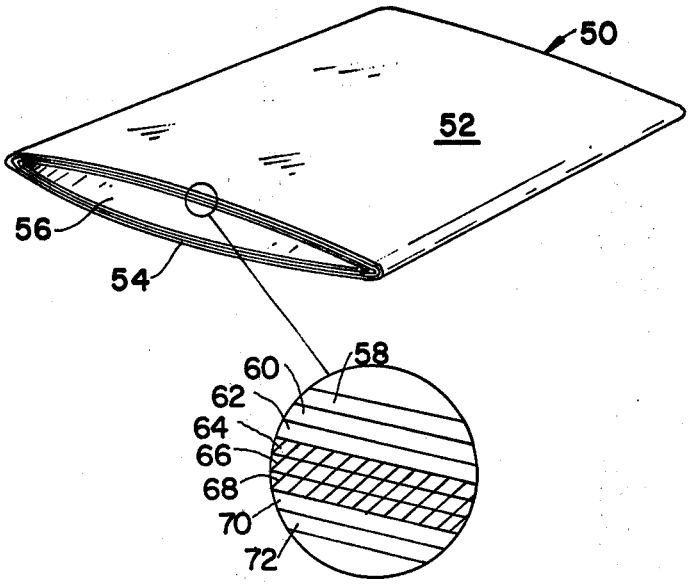
FIG. 2 is a perspective view of a coded package employing the principles of the present invention.

More particularly, referring now to FIG. 1, there is shown diagrammatically the various steps utilized in producing paperboard material. Although any multiply forming machine or process may be employed, the particular process shown is commonly referred to as the "cylinder machine process," and it produces paperboard material from wastepaper, or from a combination of wastepaper and virgin pulp. There will also be provided a brief description of the Fourdrinier process for making paperboard material and an explanation as to how this process would be modified in order to produce the coded paperboard material utilized in the present invention.

Referring now specifically to FIG. 1, there is shown the cylinder machine process for producing paperboard material from wastepaper, or a combination of wastepaper and virgin pulp. The wastepaper is supplied to a pulper 10 which acts to reduce the paper to a fibrous slurry having about 97 percent water. The slurry is then supplied to a cleaner 12 and a consistency regulator 14 which removes some of the contaminates and controls the consistency of the slurry. The slurry is then supplied to a unit 16 which provides further pulping, screening, and centrifugal cleaning action. Acceptable stock is drawn through an extraction gate and drops into a dilute chest 18 at 3 percent consistency. The light contaminants are pumped to a vibrating screen 20 for further screening. From the screen 20, accepted stock is sent to join the stock in dilute chest 18 supplied from the unit 16.

The accepted stock or slurry is then supplied to a cylinder covered with wire which operates to thicken the slurry by removing additional water so that the slurry is then 94 percent water and about 6 percent fiber. The slurry is then pumped to pressurized refiners 24 which operate to cut and refine the fibers to the desired size. The slurry is then pumped to a head box 26 and is then gravity fed from the head box to a pump and fine screen 28. At this point, the slurry is supplied to a series of vats having cylinders 30 rotating therein. In this particular embodiment, there are eight such cylinders, with each cylinder producing its own ply of material. Of course, the number of cylinders and plies may vary from cylinder machine to cylinder machine. A paper machine felt 32 is disposed above the eight cylinders and operates to accumulate the eight plies of material in sequence to produce a single sheet of paperboard material having eight plies. At this point in this process, the eight-ply sheet of paperboard material on the felt 32 is approximately 80 percent water and 20 percent fiber. The sheet of paperboard material is then supplied to a press section 34 which operates to remove additional water from the stock so as to increase the fiber content thereof as the paperboard material leaves the last rolls of the press section 34. From there, the paperboard material is supplied to a series of dryers 36 which are operated to remove additional water from the stock material so that it becomes approximately 95 percent fiber. At this point, the sheet of paperboard material may be wound onto a reel 38 and transferred to a rewinder 40 to be slit and rewound to specified sizes for shipment to a converter. Alternatively, instead of going to reel 38, the sheet of paperboard material may be transferred to a sheeter 42 which slits and cuts the sheet into specified sizes for shipment to a converter.

It should be understood that the above-described paperboard-making process is conventional. To produce the product authentication system of the present invention, it is only necessary to provide an indicator at a point in the papermaking process during which the stock is in the form of a slurry. It will be understood that any suitable indicator or dye may be used and that there are many known chemical indicators adaptable for the purpose. Thus, the indicator may have any suitable color. In general, effective indicators may be selected from the commonly-known dyes, with a wide variety of colors available, or even phosphorescent materials may be employed.

In the paperboard-making process disclosed in FIG. 1, it is preferred that the indicator or dye which is selected be added at head box 26 to the stock material or slurry which will form the internal plies of the final sheet. In this manner, three, four, or five of the internal plies of the sheet of paperboard material produced will have the desired color or combination of colors, so that they can act as a color code in the wall of the finally-produced paperboard package or cover. It should be understood that the head box 26 includes compartments for feeding the paper fiber as a slurry to the individual vats and cylinders 30, so that each compartment of the head box which receives an indicator will produce a coded ply. Alternatively, the indicator or dye may be added at the pulper 10.

It should also be noted that the indicator may take the form of a phosphorescent material, instead of using a colored dye. Alternatively, specially-treated fibers can be added to the paperboard material during the pulping steps of the process. Specially-treated fibers include colored or chemically-treated fibers or pretreated, non-paper fibers which would be dispersed in the coded layer.

In addition, it should also be understood that the indicator or dye may be supplied to the paperboard material by simply applying a series of spaced-apart stripes to some of the internal plies as they are formed on cylinders 30. Accordingly, in some embodiments, it may be desirable to use such indicator stripes, as opposed to coding the entire layer of paperboard material with the indicator or dye. The indicator stripes may be produced by tanks of colored dyes which apply the dye in strips to a ply as it is formed on a cylinder 30, just before the ply is picked up by the felt. Alternatively, the indicator stripes may be formed by strands of thread or plastic or colored paper stripes.

As explained above, the coded sheet of paperboard material utilized in the present invention may be produced by a multiply Fourdrinier process or any other multiply forming process, in addition to the cylinder machine process described with respect to FIG. 1. In the Fourdrinier multiply process, virgin fiber pulp and/or wastepaper is utilized to form the paperboard material. The Fourdrinier multiply process differs from the cylinder machine process in that it requires one head box to make each ply and therefore requires two head boxes to produce a two-ply sheet. In addition, in the Fourdrinier process, each head box 26 feeds the slurry to a fast-moving wire mesh conveyor to accumulate the plies, which takes the place of the felt conveyor 32. The indicator or dye is then applied between the plies to form the coded paperboard material. This is particularly suitable for paperback book covers which require a relatively thin sheet of coded paperboard material. The fast-moving wire mesh conveyor then supplies the formed sheet of coded paperboard material to press section 34, dryers 36, a conventional winder (not shown), and sheeter 42, similar to the cylinder machine process illustrated in FIG. 1.

Turning now to FIGS. 2 through 5, there are shown some examples of packages employing the coded paperboard material formed in the manner described above. For example, in FIG. 2, there is shown a package 50, such as a record album jacket, having a top wall 52, a bottom wall 54, and an opening 56 for receipt of the record to be packaged. It will be noted that the upper wall 52 of the package is formed from a single sheet of paperboard material which includes, by way of example only, eight plies of paperboard material, designated 58, 60, 62, 64, 66, 68, 70, and 72. This sheet has been formed on a cylinder machine, as described above. In a preferred embodiment, internal plies 64, 66, and 68 are coded with a suitable indicator or dye. For example, if a red dye is employed, then the exposed edges of these plies will be red and will be visibly distinct from the remaining upper and lower plies. In this manner, the package 50 may be easily inspected for authenticity by merely viewing the exposed edges of upper and lower walls 52, 54 to determine if there is one or more color-coded plies. In such a manner, the product's authenticity can be determined by simply viewing the package, and it is not necessary to damage or destroy the package in order to perform the inspection. In addition, the authentic products may be readily distinguished from the counterfeit products by simply viewing the exposed edges of walls 52, 54 of the package.

Figure 3:
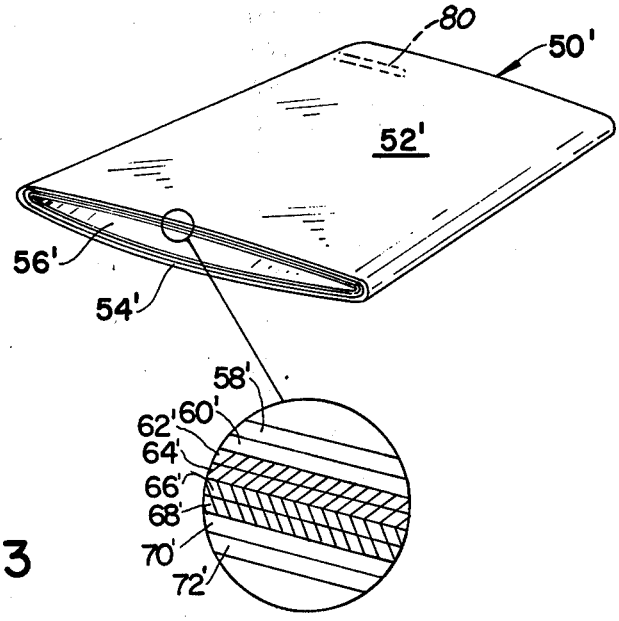
FIG. 3 is a perspective view of a modified form of a coded package employing the principles of the present invention.

Referring now to FIG. 3, there is shown a modified form of the product authentication system of the present invention as employed on a package 50'. In this embodiment, upper wall 52' also includes eight plies of paperboard material, designated 58' to 72', with internal plies 62' and 64' being coded with a dye of the same color, such as red, and internal plies 66' and 68' being coded with a dye of a different color, such as green. These color-coded plies will be easily visible along their exposed edges so that the package 50' can be easily inspected for authenticity without damaging or destroying the package.

It should also be noted that in accordance with the present invention, a tear strip 80 can be provided on the package or cover. When the tear strip is removed, it will remove upper plies 58' and 60' to expose the coded plies of the paperboard material.

Figure 4:
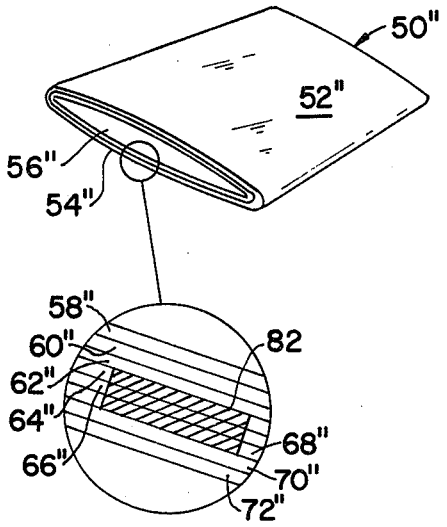
FIGS. 4 and 5 illustrate other alternative embodiments of coded packages.

Referring now to FIG. 4, there is shown a modified form of the product authentication system of the present invention as employed on a package 50''. In this embodiment, upper wall 52'' also includes eight plies of paperboard material, designated 58'' to 72'', with internal plies 64'', 66'', and 68'' being coded with indicator stripes 82 formed from any suitable indicator or dye. Such colored stripes 82 will be easily visible along the exposed edges of these plies so that the package 50'' can be easily inspected for authenticity without damaging or destroying the package.

Figure 5:
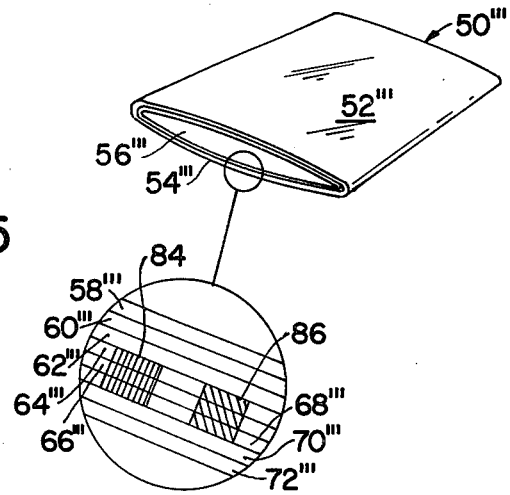

Referring now to FIG. 5, there is shown a modified form of the product authentication system of the present invention as employed on a package 50'''. In this embodiment, upper wall 52''' also includes eight plies of paperboard material, designated 58''' to 72''', with internal plies 64''', 66''', and 68''', each being coded with two rows of indicator stripes 84 and 86. In this particular embodiment, stripes 84 are formed from a red dye, and stripes 86 are formed from a green dye. Of course, stripes 84 and 86 can be formed from any suitable indicator or dye. Such colored stripes 84 and 86 will be easily visible along the exposed edges of these plies so that the package 50''' can be easily inspected for authenticity without damaging or destroying the package.

Figure 6:
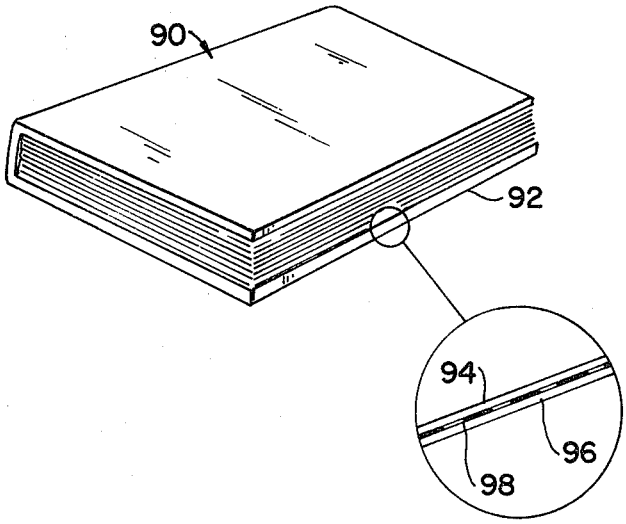
FIG. 6 is a perspective view of a coded paperback book employing the principles of the present invention.

Referring now to FIG. 6, there is shown the product authentication system of the present invention being employed in a paperback book cover 90 which may, for the purposes of this invention, be referred to as a package for containing a book. At least one wall 92 of the book cover or package 90 is provided with two plies of paperboard material designated 94 and 96. This paperboard material may be formed by the multiply Fourdrinier process described above and includes indicator stripes 98 disposed between plies 94 and 96 to form the coded paperboard sheet. Again, such stripes are visible along the exposed edge of wall 92 so that the books can be easily inspected for authenticity.

It should also be apparent that utilizing more than one coded intermediate ply enhances the ability to visually check the coded edge of the package or cover. In addition, it is also especially useful to provide uncoded plies between coded plies, as it is difficult to duplicate the layered effect of uncoded plies adjacent to coded plies, such as by marking or painting the edges of the plies.

Although the present invention has been disclosed with respect to record jackets, books, and the like, the product authentication system of the present invention has wide application to all types of paperboard-formed packages or covers which have plies which can be coded to indicate the authenticity of the product. For example, the present invention has specific application to tape boxes, perfume boxes, drug boxes, toy boxes, and the like.

It will be appreciated that the product authentication system of the present invention is inexpensive to produce and implement, since it only requires the addition of an indicator or dye to the paperboard material, which does not significantly increase its cost. Moreover, even if potential counterfeiters were to discover the use of the color code for a particular record, book, or other product, it would be difficult for such counterfeiters to duplicate, since the coded paperboard material must be produced by paperboard manufacturers, and the paperboard manufactures will supply the coded paperboard material only to converters authorized to produce the authentic package or covers. Moreover, it would be difficult, if not impossible, for counterfeiters to mark the edges of only the internal plies of a sheet to duplicate the code.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A device for authenticating a product contained in a package, comprising:
   - a plurality of walls connected to form said package,
   - at least one of said walls having two external surfaces and including a sheet of paperboard material having an exposed edge along said at least one wall, said sheet being formed from a plurality of plies of paperboard material to form an integral laminate,
   - at least one ply of said plurality of plies being coded between said external surfaces of said at least one wall along at least a portion of a surface of said one ply covered by said other plies and along an exposed outer edge thereof to act as an indicator, and
   - the exposed outer edge of said coded ply being visible along the exposed edge of said at least one wall to indicate the authenticity of said product.

2. A device in accordance with claim 1, wherein said coded ply includes a dye.

3. A device in accordance with claim 1, wherein said coded ply includes a phosphorescent material.

4. A device in accordance with claim 1, wherein said coded ply includes fibers treated with an indicating material.

5. A device in accordance with claim 1, wherein said coded indicator extends continuously over the entire ply.

6. A device in accordance with claim 1, wherein said coded ply includes indicator stripes to form said coded ply.

7. A device in accordance with claim 1, wherein at least a portion of said coded ply is covered by a removable tear strip for exposing to view said coded ply.

8. A device in accordance with claim 1, wherein at least two adjacent internal plies are provided and are coded to act as an indicator.

9. A device in accordance with claim 1, wherein two non-adjacent internal plies are provided and are coded to act as an indicator.

10. A device in accordance with claim 1, wherein at least two internal plies are provided and are coded to act as an indicator, the code of one of said coded plies being different from the code of the other of said coded plies.

11. A record album jacket, comprising:
   - an upper and a lower wall,
   - said walls being connected along three edges to define an opening,
   - at least one of said walls including a sheet of paperboard material having an exposed edge adjacent said opening,
   - said sheet being formed from a plurality of plies of paperboard material to form an integral laminate and including at least one internal ply,
   - said at least one internal ply being coded along at least a portion of a surface of said internal ply covered by said other plies and along an exposed outer edge thereof to act as an indicator, and
   - the exposed outer edge of said coded ply being visible along said exposed edge of said sheet to indicate the authenticity of said album jacket.

12. A device in accordance with claim 11, wherein said coded ply includes a dye.

13. A device in accordance with claim 11, wherein said coded ply includes a phosphorescent material.

14. A device in accordance with claim 11, wherein said coded ply includes fibers treated with an indicating material.

15. A device in accordance with claim 11, wherein said coded indicator extends continuously over the entire ply.

16. A device in accordance with claim 11, wherein said coded ply includes indicator stripes to form said coded ply.

17. A device in accordance with claim 11, wherein at least a portion of said coded ply is covered by a removable tear strip for exposing to view said coded ply.

18. A device in accordance with claim 11, wherein at least two adjacent internal plies are provided and are coded to act as an indicator.

19. A device in accordance with claim 11, wherein two non-adjacent internal plies are provided and are coded to act as an indicator.

20. A device in accordance with claim 11, wherein at least two internal plies are provided and are coded to act as an indicator, the code of one of said coded plies being different from the code of the other of said coded plies.

21. A book jacket, comprising:
   - a front cover and a back cover,
   - said covers being connected to define a book jacket,
   - at least one of said covers including a sheet of paperboard material having an exposed edge, said sheet being formed from a plurality of plies of paperboard material to form an integral laminate with one of said plies including an internal surface, said internal surface being coded along at least a portion of said internal surface covered by said other plies and along an exposed edge of said at least one cover to act as an indicator, and the exposed edge of said coded surface being visible along said exposed edge of said at least one cover to indicate the authenticity of said book jacket.

22. A device in accordance with claim 21, wherein said coded surface includes a dye.

23. A device in accordance with claim 21, wherein said coded surface includes a phosphorescent material.

24. A device in accordance with claim 21, wherein said coded surface includes fibers treated with an indicating material.

25. A device in accordance with claim 21, wherein said coded surface includes an indicator extending continuously over the entire surface.

26. A device in accordance with claim 21, wherein said coded surface includes indicator stripes to form said coded surface.

27. A device in accordance with claim 21, wherein at least a portion of said coded surface is covered by a removable tear strip for exposing to view said coded surface.

28. A device for authenticating a product contained in a package, comprising:

a plurality of walls connected to form said package, at least one of said walls having two external surfaces and including a sheet of paperboard material, said sheet being formed from a plurality of plies of paperboard material to form an integral laminate, at least one ply being coded between said external surfaces of said at least one wall along at least a portion of said one ply cover by said other plies to act as an indicator, and at least a portion of said coded ply being covered by a removable tear strip for exposing to view said coded ply in said at least one wall to indicate the authenticity of said product.

29. A device in accordance with claim 1, wherein said coded ply is visible along the exposed edge of said at least one wall.

30. A device in accordance with claim 28, wherein said coded ply is an internal ply of said sheet.

31. A device in accordance with claim 28, wherein said coded ply includes a dye.

32. A device in accordance with claim 28, wherein said coded ply includes a phosphorescent material.

33. A device in accordance with claim 28, wherein said coded ply includes fibers treated with an indicating material.

34. A device in accordance with claim 28, wherein said coded indicator extends continuously over the entire ply.

35. A device in accordance with claim 28, wherein said coded ply includes indicator stripes to form said coded ply.

36. A device in accordance with claim 28, wherein at least two adjacent internal plies are provided and are coded to act as an indicator.

37. A device in accordance with claim 28, wherein two non-adjacent internal plies are provided and are coded to act as an indicator.

38. A device in accordance with claim 28, wherein at least two internal plies are provided and are coded to act as an indicator, the code of one of said coded plies being different from the code of the other of said coded plies.

* * * * *